US005645021A

United States Patent [19]

Eguchi et al.

[11] Patent Number: 5,645,021

[45] Date of Patent: Jul. 8, 1997

[54] VALVE TIMING ADJUSTING MECHANISM FOR INTERNAL COMBUSTION ENGINE

[75] Inventors: Katsuhiko Eguchi, Kariya; Naoki Kira, Anjo, both of Japan

[73] Assignee: Aisin Seiki Kabushiki Kaisha, Aichi-pref., Japan

[21] Appl. No.: 686,425

[22] Filed: Jul. 26, 1996

[30] Foreign Application Priority Data

Jul. 28, 1995 [JP] Japan ..... 7-193745

[51] Int. Cl.[6] ..... F01L 1/344

[52] U.S. Cl. ..... 123/90.17; 123/90.31; 74/568 R; 464/2

[58] Field of Search ..... 123/90.15, 90.17, 123/90.31; 74/568 R; 464/1, 2, 160

[56] References Cited

U.S. PATENT DOCUMENTS

| | | | |
|---|---|---|---|
| 4,811,698 | 3/1989 | Akasaka et al. | 123/90.17 |
| 5,058,539 | 10/1991 | Saito et al. | 123/90.17 |
| 5,167,206 | 12/1992 | Suga | 123/90.17 |
| 5,197,421 | 3/1993 | Hara | 123/90.17 |
| 5,203,290 | 4/1993 | Tsuruta et al. | 123/90.17 |
| 5,209,193 | 5/1993 | Uchida et al. | 123/90.17 |
| 5,447,126 | 9/1995 | Kondoh et al. | 123/90.31 |

FOREIGN PATENT DOCUMENTS 5-77842 10/1993 Japan .

*Primary Examiner*—Weilun Lo

*Attorney, Agent, or Firm*—Hazel & Thomas

[57] ABSTRACT

A valve timing adjusting mechanism for an internal combustion engine includes an internal gear mounted on either one of a crankshaft or a cam shaft of the engine for rotation therewith, an external gear assembled in surrounding relationship with the internal gear, the external gear being driving connected to the other one of the crankshaft and camshaft for rotation therewith, and an intermediate gear set disposed in an annular space between the internal and external gears to be moved by fluid under pressure applied thereto in an axial direction for effecting relative rotation of the internal and external gears. The intermediate gear set is composed of a primary gear formed with internal teeth in meshing engagement with external teeth of the internal gear and external teeth in meshing engagement with internal teeth of the external gear, an auxiliary gear formed with internal teeth in meshing engagement with the external teeth of the internal gear and external teeth in meshing engagement with the internal teeth of the external gear, and a plurality of circumferentially equally spaced retainer elements interposed between the primary and auxiliary gears, the retainer elements being adapted to adjust an axial distance between the primary and auxiliary gears and retained in a position where backlashes at the meshed portions of the component gears are eliminated.

4 Claims, 10 Drawing Sheets

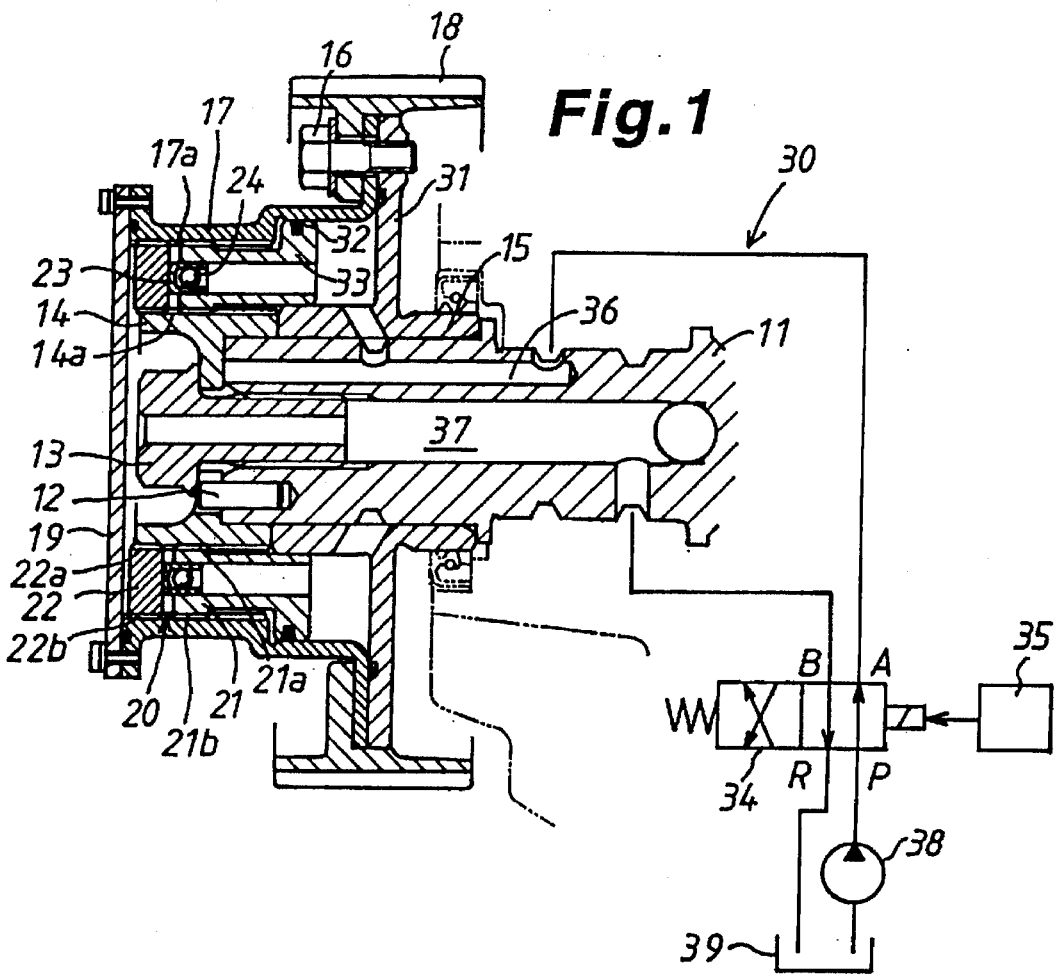
Fig.1
Fig.2
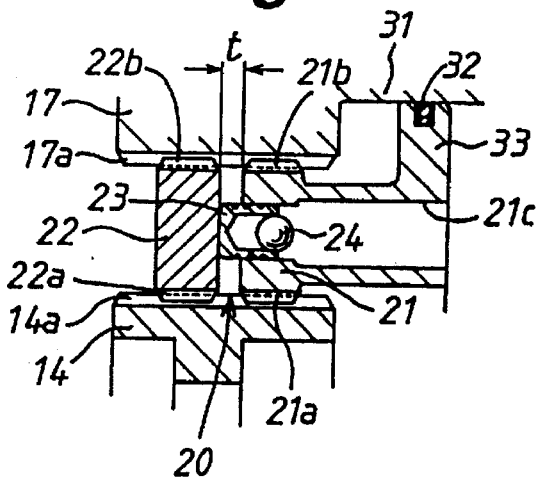

VALVE TIMING ADJUSTING MECHANISM FOR INTERNAL COMBUSTION ENGINE

BACKGROUND OF THE INVENTION

1. Field of the Invention

The present invention relates to a valve timing adjusting mechanism for adjusting operation timing of intake and exhaust valves in an internal combustion engine.

2. Description of the Prior Art

Disclosed in Japanese Patent Publication No. 5(1993)-77842 is a valve timing adjusting mechanism of this kind which includes an internal gear formed with external helical teeth and mounted on either one of a crankshaft or a camshaft of the engine for rotation therewith, an external gear formed with internal helical teeth and assembled in surrounding relationship with the internal gear, the external gear being drivingly connected to the other one of the crankshaft and camshaft for rotation therewith, an intermediate gear set in meshing engagement with the external helical teeth of the internal gear and in meshing engagement with the internal helical teeth of the external gear, the intermediate gear set being disposed in an annular space between the internal and external gears to be moved in an axial direction for effecting relative rotation of the internal gear and the external gear thereby to change rotational phase between the crankshaft and the camshaft, and a hydraulic driving mechanism for effecting axial movement of the intermediate gear set.

In the valve timing adjusting mechanism described above, the intermediate gear set is composed of a primary gear formed with internal helical teeth in meshing engagement with the external helical teeth of the internal gear and external helical teeth in meshing engagement with the internal helical teeth of the external gear and an auxiliary gear formed with internal helical teeth in meshing engagement with the external helical teeth of the internal gear and external helical teeth in meshing engagement with the internal helical teeth of the external gear. The auxiliary gear is connected with the primary gear through a resilient member and loaded by the resilient member in an opposite direction relative to the primary gear to eliminate backlashes between the internal helical teeth of the auxiliary gear and the external helical teeth of the internal gear and between the external helical teeth of the auxiliary gear and the internal helical teeth of the external gear.

Since in the valve timing adjusting mechanism, the primary and auxiliary gears are loaded by the resilient member in the opposite direction to eliminate backlashes at the meshed portions of the component gears, it is needed to adjust the biasing force of the resilient member in accordance with torque fluctuation of the internal combustion engine. If the backlashes at the meshed portions may not be eliminated due to fatigue of the resilient member, there will occur problems such as the occurrence of gear noises, irregularity in operation of the intake and exhaust valves, etc. In addition, smooth axial movement of the intermediate gear set may not be effected due to frictional engagement forces caused by the resilient member.

SUMMARY OF THE INVENTION

It is, therefore, a primary object of the present invention to provide an improved valve timing adjusting mechanism capable of overcoming the problems discussed above.

According to the present invention, the primary object is accomplished by providing a valve timing adjusting mechanism for an internal combustion engine which comprises an internal gear formed with external teeth and mounted on either one of a crankshaft or a cam shaft of the engine for rotation therewith, an external gear formed with internal teeth and assembled in surrounding relationship with the internal gear, the external gear being driving connected to the other one of the crankshaft and camshaft for rotation therewith, and an intermediate gear set disposed in an annular space between the internal and external gears to be moved by fluid under pressure applied thereto in an axial direction for effecting relative rotation of the internal and external gears, wherein the intermediate gear set comprises a primary gear formed with internal teeth in meshing engagement with the external teeth of the internal gear and external teeth in meshing engagement with the internal teeth of the external gear, an auxiliary gear formed with internal teeth in meshing engagement with the external teeth of the internal gear and external teeth in meshing engagement with the internal teeth of the external gear, and restriction means interposed between the primary and auxiliary gears in a condition where the primary and auxiliary gears have been disposed between the internal and external gears, the restriction means being adapted to adjust an axial distance between the primary and auxiliary gears and retained in a position where backlashes at the meshed portions of the component gears are eliminated.

According to an aspect of the present invention, the restriction means comprises a retainer element such as a retainer plug, pin or ring coupled within the primary gear and retained in a position where backlashes at the meshed portions of the component gears are eliminated, the retainer element being maintained in engagement with the auxiliary gear.

BRIEF DESCRIPTION OF THE DRAWINGS

Other objects, features and advantages of the present invention will be more readily appreciated from the following detailed description of preferred embodiments thereof when taken together with the accompanying drawings, in which:

FIG. 1 is a sectional view of a valve timing adjusting mechanism in accordance with the present invention;

FIG. 2 is an enlarged sectional view of an intermediate gear set shown in FIG. 1;

DESCRIPTION OF THE PREFERRED EMBODIMENTS

Figure 3:
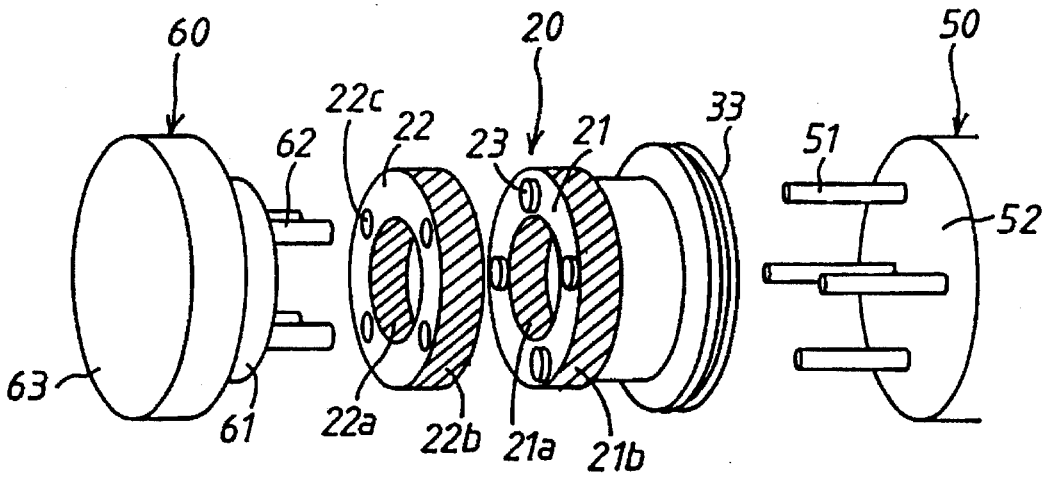
FIG. 3 illustrates tools for assembling the intermediate gear set shown in FIG. 1.

Illustrated in FIGS. 1 and 2 is a first embodiment of a valve timing adjusting mechanism in accordance with the present invention, which is adapted to adjust each operation timing of intake and exhaust valves in an internal combustion engine. In this embodiment, an internal gear 14 is coaxially mounted on a camshaft 11 of the internal combustion engine and retained in position by means of a positioning pin 12 and a fastening bolt 13 for rotation with the camshaft 11. A hub member 15 is rotatably mounted on the camshaft 11. An external gear 17 and a timing pulley 18 are assembled with the hub member 15 by means of bolts 16 for rotation therewith. The timing pulley 18 is drivingly connected to a crankshaft (not shown.) of the engine by means of a timing belt (not shown) to be driven by the engine.

The internal gear 14 has a cylindrical portion of a predetermined length which is formed with external helical teeth 14*a*. The external gear 17 is in the form of a cylindrical member which is formed with internal helical teeth 17*a* and placed in surrounding relationship with the internal gear 14. Disposed within an annular space between the internal and external gears 14 and 17 is an intermediate gear set 20 which is moved in an axial direction under control a hydraulic driving mechanism 30. An outer end of the external gear 17 is covered with a cover plate 19 detachably fixed thereto by means of bolts.

The intermediate gear set 20 is composed of a primary gear 21 in the form of an annular member which is formed with internal helical teeth 21*a* in meshing engagement with the external helical teeth 14*a* of internal gear 14 and external helical teeth 21*b* in meshing engagement with the internal helical teeth 17*a* of external gear 17 and an auxiliary gear 22 in the form of an annular member which is formed with internal helical teeth 22*a* in meshing engagement with the external helical teeth 14*a* of internal gear 14 and external helical teeth 22*b* in meshing engagement with the internal helical teeth 17*a* of external gear 17. A plurality of circumferentially equally spaced plugs 23 and steel balls 24 are assembled within the primary gear 21 to define an axial displacement amount "t" of the auxiliary gear 22 relative to the primary gear 21. When moved in an axial direction, the intermediate gear set 20 causes relative rotation of the primary and auxiliary gears 14 and 17 to change rotational phase of the crankshaft relative to the camshaft 11.

The plugs 23 each are in the form of a cup-shaped member of iron which is formed with a plurality of axially spaced annular grooves. The plugs 23 each are slidably coupled within corresponding axial mounting holes 21*c* in the primary gear 21 and fixed in position by means of the steel balls 24 pressed therein. The plug 23 and steel ball 24 are adapted as an anti-pressure sealing member and interposed between the primary gear 21 and auxiliary gear 22 in a condition where the primary and auxiliary gears 21 and 22 have been disposed between the internal and external gears 14 and 17. Thus, the axial distance between the primary and auxiliary gears 21 and 22 can be adjusted by the plugs 23 and maintained in the adjusted condition by pressing the steel balls 24 into the plugs 23.

The hydraulic driving mechanism 30 includes a cylinder 31 formed by the internal gear 14, hub member 15 and external gear 17, a piston 33 integrally formed with the primary gear 21 and axially slidably disposed within the cylinder 31 through a seal ring 32, an electrically operated fluid control valve 34 for controlling fluid under pressure applied to the piston 33 and an electric control device 35 for control of the fluid control valve 34. A fluid chamber formed at the right side of piston 33 is connected to an outlet port A of the control valve 34 through a fluid passage 36 formed in the hub member 15 and camshaft 11, while a fluid chamber formed at the left side of piston 33 is connected to a return port B of the control valve 34 through the meshed portions of the component gears and a fluid passage 37 formed in the fastening bolt 13 and camshaft 11. An inlet port P of the control valve 34 is connected to a fluid pump 38, while a discharge port R of the control valve 34 is connected to a fluid reservoir 39. When the control valve 34 is switched over under control of the electric control device 35, axial movement of the piston 33 is effected by fluid under pressure supplied from the fluid pump 38 to cause axial movement of the intermediate gear set 20.

In this embodiment, the plugs 23 are assembled within the primary gear 21 in a condition where the primary and auxiliary gears 21 and 22 have been meshed with the external helical teeth 14*a* of internal gear 14 at their internal helical teeth 21*a* and 22*a* and meshed with the internal helical teeth 17*a* of external gear 17 at their external helical teeth 21*b* and 22*b*. Thus, the plugs 23 are interposed between the primary gear 21 and auxiliary gear 22 and moved in an axial direction to increase or decrease a distance between the primary and auxiliary gears 21 and 22. This means that the internal and external helical teeth of the intermediate gear set 20 formed by combination of the primary and auxiliary gears 21 and 22 are increased or decreased in axial length to eliminate backlashes at the meshed portions of the helical teeth 14*a* and 21*a*, 22*a*; 17*a* and 21*b*, 22*b*. In such a condition as described above, the steel balls 24 are pressed into the plugs 23 to determine an axial displacement amount "t" of the auxiliary gear 22 relative to the primary gear 21 and to fix the distance between the primary and auxiliary gears 21 and 22.

During the foregoing assembly process, the plugs 23 are assembled with the primary gear 21 by using tools 50 and 60 shown in FIG. 3. The right-hand tool 50 is composed of circumferentially equally spaced four push pins 51 which are fixedly supported by a support block 52 to be inserted into corresponding mounting holes 21*c* in the primary gear 21, while the left-hand tool 60 is composed of a support block 61 to be brought into contact with an end face of the auxiliary gear 22, circumferentially equally spaced four retainer pins 62 which are retractably assembled with the support block 61 to be inserted into corresponding holes 22*c* in the auxiliary gear 22, and a base block 63 supporting the support block 61 and retainer pins 62 thereon. The retainer pins 62 assembled with the support block 61 are loaded by springs (not shown) to be resiliently engaged with an end face of the primary gear 21 when inserted into the corresponding holes 22*c* in auxiliary gear 22.

In a condition where the primary and auxiliary gears 21 and 22 are maintained in meshing engagement with the internal and external gears 14 and 17, the plugs 23 are inserted into the mounting holes 21*c* in the primary gear 21, and the push pins 51 of tool 50 are inserted into the mounting holes 21*c* to move the plugs 23 and retain them in a position where the axial displacement amount "t" of the auxiliary gear 22 relative to the primary gear 21 is determined to eliminate backlashes at the meshed portions of the component gears. Thereafter, the push pins 51 of tool 50 are removed from the mounting holes 21*c*, and the steel balls 24 are inserted into the mounting holes 21*c*. In such a condition, the push pins 51 of tool 50 are inserted again into the mounting holes 21*c* to couple the steel balls 24 with the plugs 23, while the spring loaded retainer pins 62 are inserted into the corresponding holes 22*c* in auxiliary gear 22 and engaged with the end face of the primary gear 21 so that the support block 61 is engaged with the end face of auxiliary gear 22. Thus, the steel balls 24 are pressed into the plugs 23 by means of the push pins 51 of tool 50 to retain the plugs 23 in position.

As is understood from the above description, the valve timing adjusting mechanism can be assembled with the camshaft in the same manner without any tuning when applied to internal combustion engines different in torque fluctuation. This is useful to enhance efficiency of the assembly work of the component parts. Since the axial displacement amount "t" of the auxiliary gear 22 relative to the primary gear 21 is defined by the plugs 23 retained in position as shown in FIG. 2, the plugs 23 and steel balls 24 do not act to resiliently bias the primary and auxiliary gears 21 and 22 in an opposite direction. This is useful to eliminate the occurrence of useless frictional engagement forces between the primary and auxiliary gears 21 and 22 and the internal and external gears 14 and 17. As a result, the intermediate gear set 20 is smoothly moved in an axial direction under control of the hydraulic driving mechanism 30, and the component gears of the valve timing adjusting mechanism are maintained without causing any undesired backlashes thereof for a long period of time.

Figure 4:
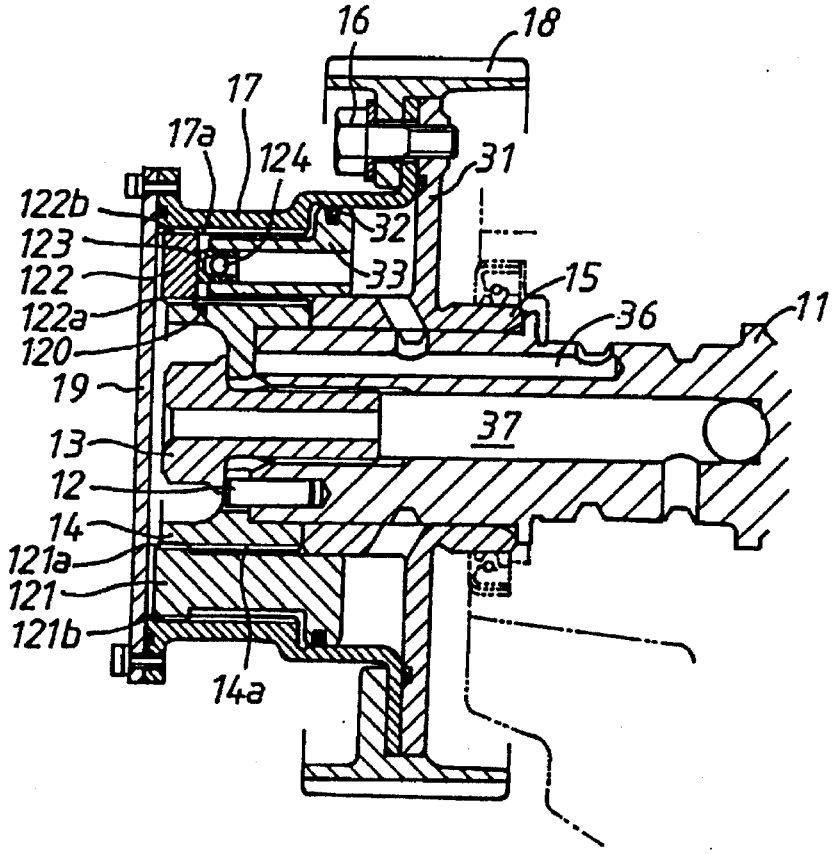
FIG. 4 is a sectional view of a modification of the valve timing adjusting mechanism shown in FIG. 1.
Figure 5:
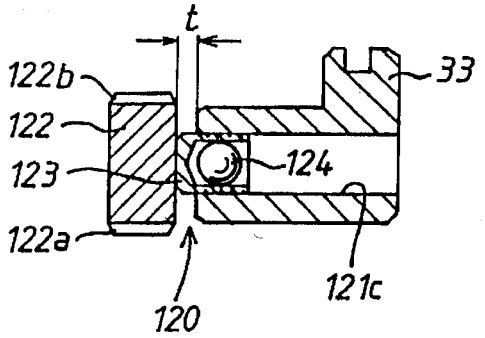
FIG. 5 is an enlarged view of an intermediate gear set shown in FIG. 4.
Figure 6:
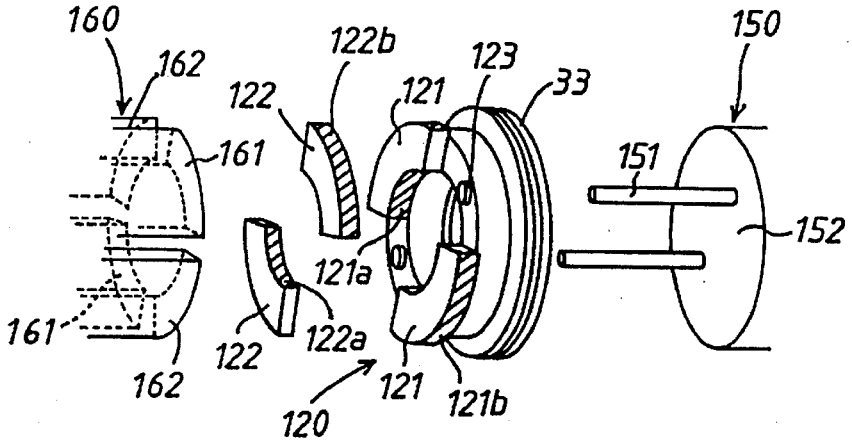
FIG. 6 illustrates tools for assembling the intermediate gear set shown in FIG. 4.

Illustrated in FIGS. 4–6 is a modification of the valve timing adjusting mechanism shown in FIG. 1, wherein the intermediate gear set 20 is replaced with an intermediate gear set 120 which is composed of a pair of circumferentially spaced semi-circular primary gears 121 integrally formed with the piston 33 and having internal helical teeth 121*a* in meshing engagement with the external helical teeth 14*a* of the internal gear 14 and external helical teeth 121*b* in meshing engagement with the internal helical teeth 17*a* of external gear 17 and a pair of semi-circular auxiliary gears 122 axially movably disposed between the primary gears 121 and having internal helical teeth 122*a* in meshing engagement with the external helical teeth 14*a* of internal gear 14 and external helical teeth 122*b* in meshing engagement with the internal helical teeth 17*a* of external gear 17. A pair of plugs 123 are axially movably coupled within mounting holes 121*c* in the piston body 33 and retained in position by means of steel balls 124 pressed therein to define an axial displacement amount "t" of the auxiliary gears 122 relative to the primary gears 121.

In the modification described above, the plugs 123 are assembled with the primary gears 121 in a condition where the primary and ancillary gears 121 and 122 have been meshed with the external teeth 14*a* of internal gear 14 at their internal helical teeth 121*a* and 122*a* and meshed with the internal helical teeth 17*a* of external gear 17 at their external helical teeth 121*b* and 122*b*. Thus, the plugs 123 are interposed between the primary gears 121 and the auxiliary gears 122 and moved in an axial direction to increase or decrease an axial distance between the primary and auxiliary gears 121 and 122. This means that the internal and external helical teeth of the intermediate gear set 120 formed by combination of the primary and auxiliary gears 121 and 122 is increased or decreased in axial length to eliminate backlashes at the meshed portions of the helical teeth 14*a* and 121*a*, 122*a*; 17*a* and 121*b*, 122*b*. In such a condition as described above, the steel balls 124 are pressed into the plugs 123 to define an axial displacement amount "t" of the auxiliary gears 122 relative to the primary gears 121 and to fix the axial distance between the primary and auxiliary gears 121 and 122.

During the foregoing assembly process, the plugs 123 are assembled with the primary gears 121 by using tools 150 and 160 shown in FIG. 6. The right-hand tool 150 is composed of a pair of push pins 151 which are fixedly supported by a support block 152 to be inserted into corresponding mounting holes 121*c* in the piston body 33, while the left-hand tool 160 is composed of a pair of pressure receiving blocks 161 to be brought into contact with each end face of the auxiliary gears 122 and a pair of movable retainer blocks 162 which are retractably assembled with the pressure receiving blocks 161 and loaded by springs (not shown) to be resiliently engaged with each end face of the primary gears 121 when the pressure receiving blocks 161 have been engaged with the end faces of the auxiliary gears 122. In a condition where the primary and auxiliary gears 121 and 122 are maintained in meshing engagement with the internal and external gears 14 and 17, the plugs 123 are inserted into the mounting holes 121*c* in the piston body 33, and the push pins 151 of tool 150 are inserted into the mounting holes 121*c* to move the plugs 123 and retain them in a position where the axial displacement amount "t" of the auxiliary gears 122 relative to the primary gears 121 is determined to eliminate backlashes at the meshed portions of the component gears. Thereafter, the push pins 151 of tool 150 are removed from the mounting holes 121*c*, and the steel balls 124 are inserted into the mounting holes 121*c*. In such a condition, the push pins 151 of tool 50 are inserted again into the mounting holes 121*c* to couple the steel balls 124 with the plugs 123, while the pressure receiving blocks 161 and movable retainer blocks 162 of tool 160 are engaged with the end faces of auxiliary and primary gears 122 and 121 respectively. Thus, the steel balls 124 are pressed into the plugs 123 by means of the push pins 151 of tool 150 to retain the plugs 123 in position.

Accordingly, the valve timing adjusting mechanism can be assembled with the cam shaft 11 in the same manner without any tuning when applied to internal combustion engines different in torque fluctuation. This is useful to enhance efficiency of the assembly work of the component parts. Since the axial displacement amount "t" of the auxiliary gears 122 relative to the primary gears 121 is defined by the plugs 123 retained in position as shown in FIG. 5, the plugs 123 and steel balls 124 do not act to resiliently bias the primary and auxiliary gears 121 and 122 in an opposite direction. This is useful to eliminate the occurrence of useless frictional engagement forces between the primary and auxiliary gears 121 and 122 and the internal and external gears 14 and 17. As a result, the intermediate gear set 120 is smoothly moved in an axial direction under control of the hydraulic driving mechanism 30, and the component gears of the valve timing adjusting mechanism are maintained without causing any undesired backlashes thereof for a long period of time. In addition, the axial length of the intermediate gear set 120 can be shortened since the auxiliary gears 122 are placed between the primary gears 121. This useful to provide the valve timing adjusting mechanism in a compact size.

Figure 7:
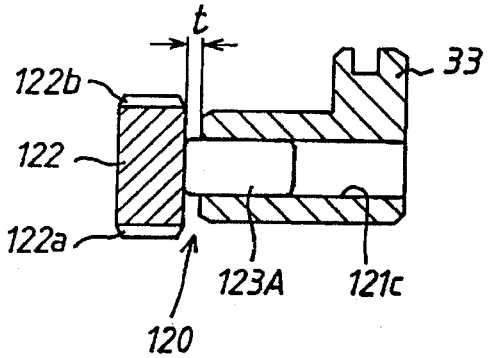
FIG. 7 is an enlarged sectional view of a modification of the intermediate gear set shown in FIG. 5.
Figure 8:
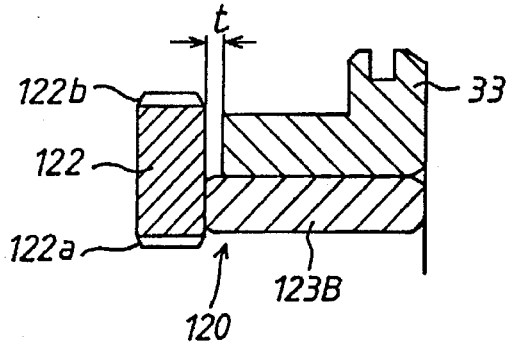
FIG. 8 is an enlarged sectional view of another modification of the intermediate gear set shown in FIG. 5.
Figure 9:
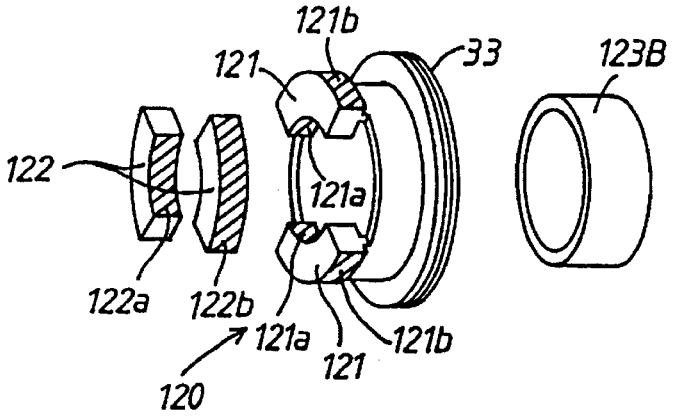
FIG. 9 is a perspective view showing a disassembled condition of the intermediate gear set shown in FIG. 8.
Figure 10:
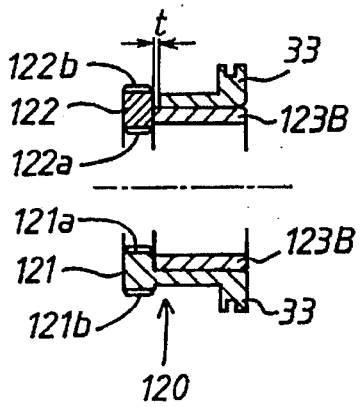
FIG. 10 is a sectional view of the intermediate gear set shown in FIG. 8.

Although in the above modification, the plugs 123 and steel balls 124 are adapted to define the axial displacement amount "t" of the auxiliary gears 122 relative to the primary gears 121, the plug 123 and steel ball 124 may be replaced with a press-in pin 123A shown in FIG. 7 or a press-in ring 123B shown in FIGS. 8–10. In use of the press-in pin 123A or ring 123B, it is required to measure the axial displacement amount "t" of the auxiliary gears 122 relative to the primary gears 121 for eliminating backlashes at the meshed portions of the component gears. After measurement of the axial displacement amount "t", the press-in pin 123A or ring 123B is pressed into the mounting holes 121*c* in the piston body 33 and retained in a position defined by the axial displacement amount "t". In the same manner as described above, the plug 23 and steel ball 24 shown in FIGS. 1–3 may be replaced with the press-in pin 123A shown in FIG. 7.

Figure 11:
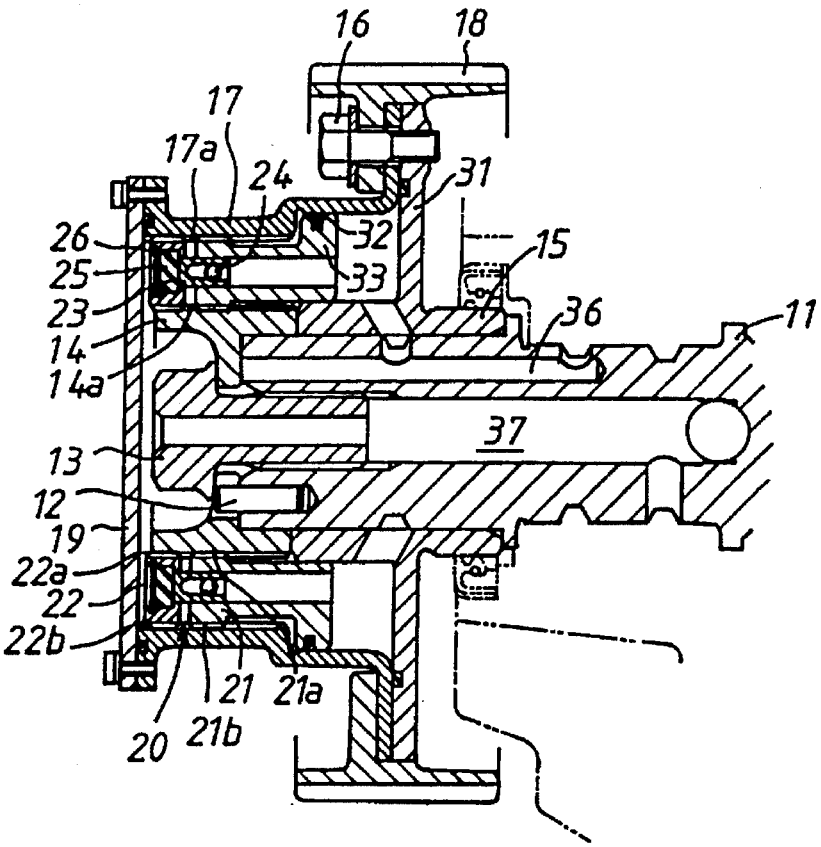
FIG. 11 is a sectional view of another modification of the valve timing adjusting mechanism shown in FIGS. 1–3.
Figure 12:
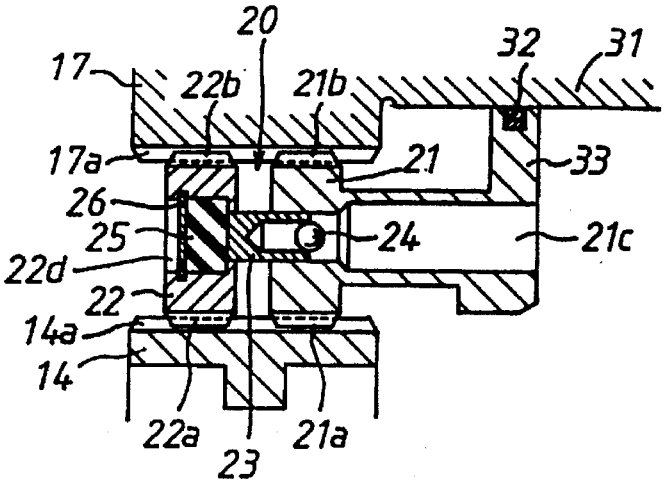
FIG. 12 is an enlarged sectional view of an intermediate gear set shown in FIG. 11.
Figure 13:
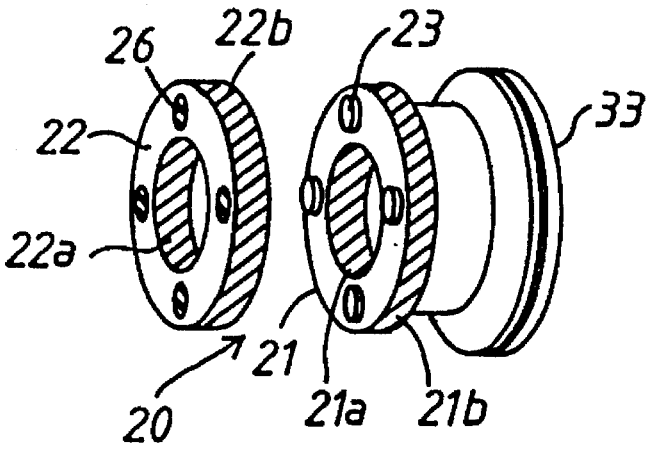
FIG. 13 is a perspective view showing a disassembled condition of the intermediate gear set shown in FIG. 11.
Figure 14:
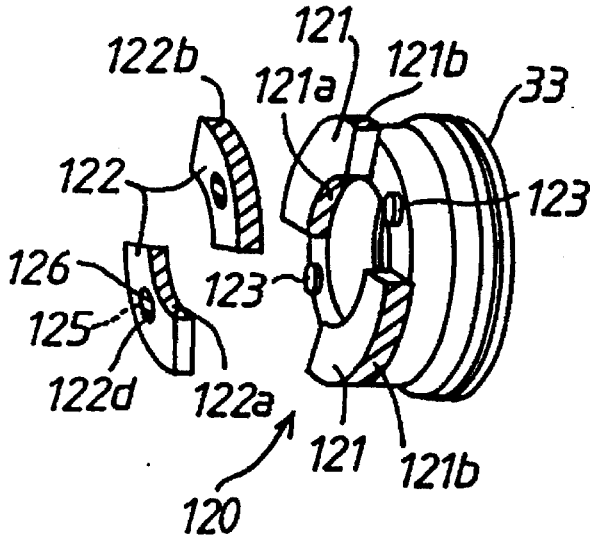
FIG. 14 is a perspective view showing a disassembled condition of another modification of the intermediate gear set shown in FIGS. 4–6.

Illustrated in FIGS. 11–13 is another modification of the valve timing adjusting mechanism shown in FIGS. 1–3, wherein the auxiliary gear 22 is formed with a stepped bore 22*d* at a portion corresponding with the plug 23. The stepped bore 22*d* has a small diameter portion coupled with the plug 23 and a large diameter portion in which a resilient element 25 of synthetic rubber is contained and retained by a lid 26 fixed to the auxiliary gear 22. When applied with an external force acting on the plug 23, the resilient element 25 causes a large resilient force against the external forece. In this modification, even if the parallelism of the component gears was out of order due to irregularity of the gears in precision or fluctuation of a tension force acting on the timing pulley 18, smooth axial movement of the intermediate gear set 20 would be effected by movement of the plug 23 against the resilient element 25. This is useful to ensure smooth movement of the intermediate gear set under control of the hydraulic driving mechanism 30. In FIG. 14 there is illustrated a modification of the intermediate gear set 120 shown in FIGS. 4–6, wherein the auxiliary gears 122 each are formed with a stepped bore 122*d* at a portion corresponding with the plug 123. The stepped bore 122*d* has a small diameter portion coupled with the plug 123 and a large diameter portion in which a resilient element 25 of synthetic rubber is contained and retained by a lid 126 fixed the auxiliary gear 122. With such arrangement of the plug 123 and resilient element 125, even if the parallelism of the component gears was out of order due to irregularity of the gears in precision or fluctuation of a tension force acting on the timing pulley 18, smooth axial movement of the intermediate gear set 120 would be effected by movement of the plug 123 against the resilient element 125.

Figure 15:
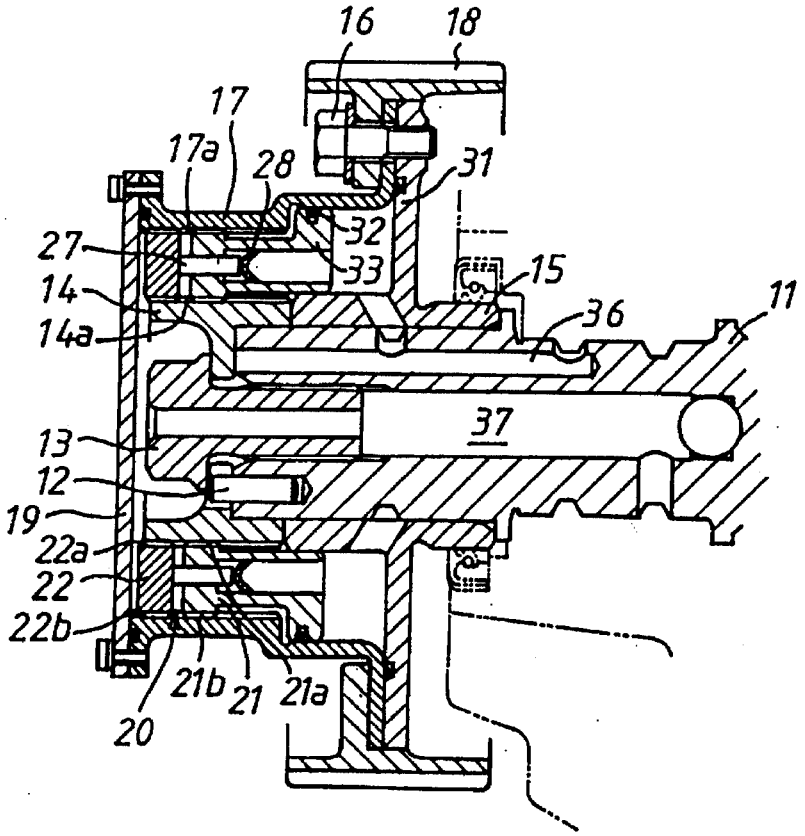
FIG. 15 is a sectional view of a further modification of the valve timing adjusting mechanism shown in FIGS. 1–3.
Figure 16:
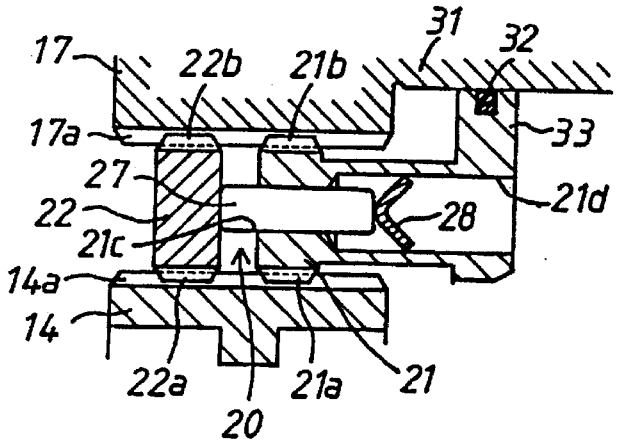
FIG. 16 is an enlarged sectional view of an intermediate gear set shown in FIG. 15.
Figure 17:
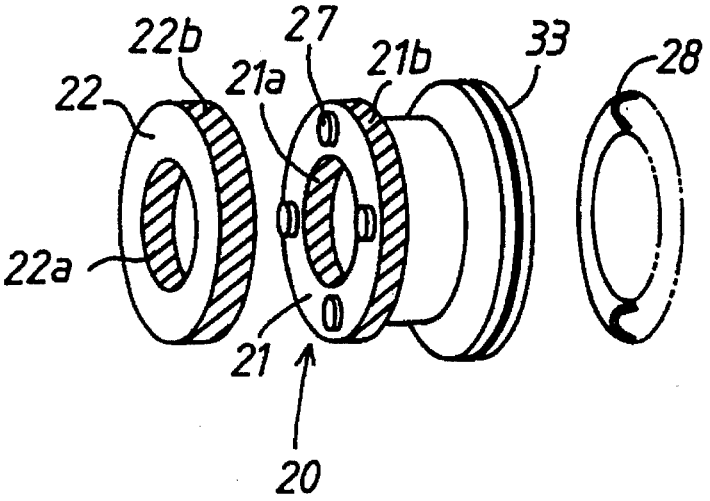
FIG. 17 is a perspective view showing a disassembled condition of the intermediate gear set shown in FIG. 15.
Figure 18:
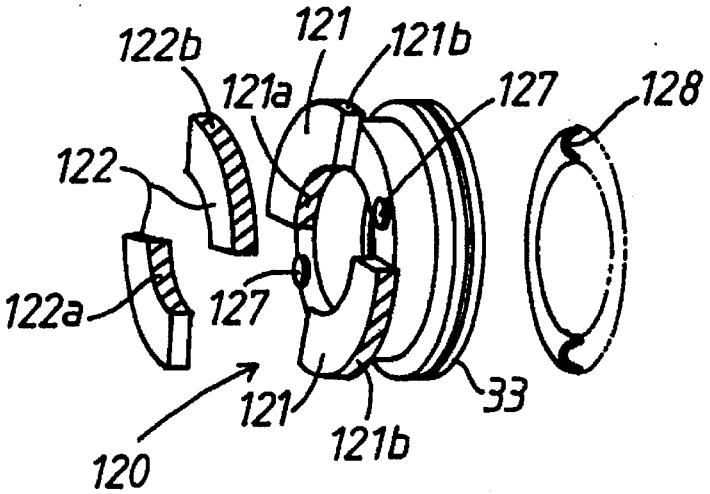
FIG. 18 is a perspective view showing a disassembled condition of a further modification of the intermediate gear set shown in FIGS. 4–6.

Illustrated in FIGS. 15–17 is another modification of the valve timing adjusting mechanism shown in FIGS. 1–3, wherein the plug 23 and steel ball 24 are replaced with a roller pin 27 and a ring 28 of steel sheet formed in a V-letter shaped cross-section. The roller pin 27 is axially slidably coupled within a small diameter portion of the axial mounting hole 21*c*, and the ring of steel sheet 28 is disposed within an annular groove 21*d* in open communication with the mounting holes 21*c* in such a manner that it is movable only to the left in the figure to retain the roller pin 27 in position. In this modification, the roller pins 27 positioned by the ring 28 of steel sheet 28 are engaged with the auxiliary gear 22 at their outer ends. With such arrangement of the roller pins 27 and ring of steel sheet 28, even if the parallelism of the component gears was out of order due to irregularity of the gears in precision or fluctuation of a tension force acting on the timing pulley 18, smooth axial movement of the intermediate gear set 20 would be effected by resilient deformation of the ring of steel sheet 28. In FIG. 18 there is illustrated a modification of the intermediate gear set 120 shown in FIGS. 4–6, wherein the plug 123 and steel ball 124 are replaced with a roller pin 127 and a ring of steel sheet 128 formed in a V-letter shaped cross-section. The roller pin 127 is axially slidably coupled within the axial mounting hole 121*c*, and the ring of steel sheet 128 is disposed within an annular groove in open communication with the mounting holes 121*c* in such a manner that it is movable only to the left in the figure to retain the roller pin 127 in position. In this modification, the roller pins 127 positioned by the ring of steel sheet 128 are engaged with the auxiliary gears 122 at their outer ends. With such arrangement of the roller pins 127 and ring of steel sheet 128, even if the parallelism of the component gears was out of order due to irregularity of the gears in precision or fluctuation of a tension force acting on the timing pulley 18, smooth axial movement of the intermediate gear set 120 would be effected by resilient deformation of the ring of steel sheet 128.

Figure 19:
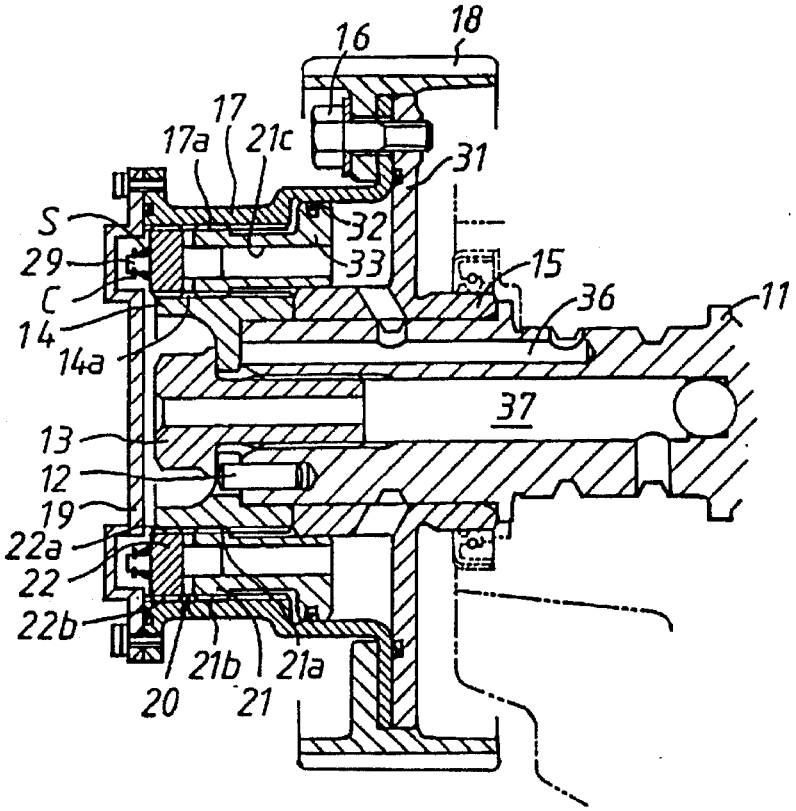
FIG. 19 is a sectional view of a modification of the valve timing adjusting mechanism shown in FIGS. 1–3.
Figure 20:
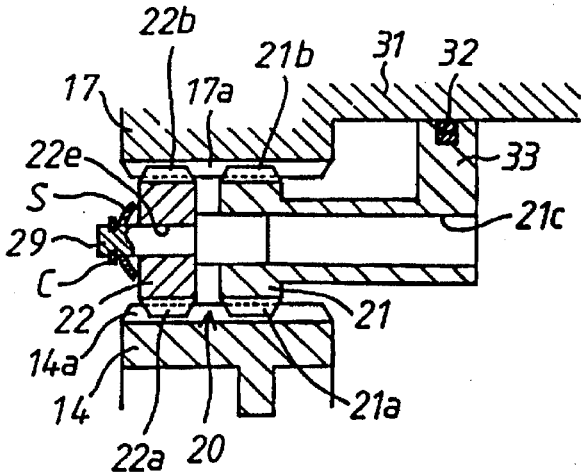
FIG. 20 is an enlarged sectional view of an intermediate gear set shown in FIG. 19.
Figure 21:
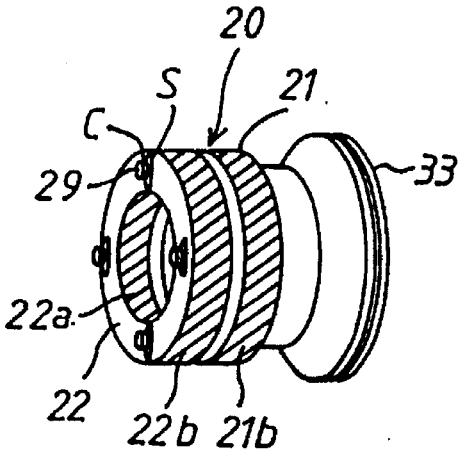
FIG. 21 is a perspective of the intermediate gear set shown in FIG. 19.
Figure 22:
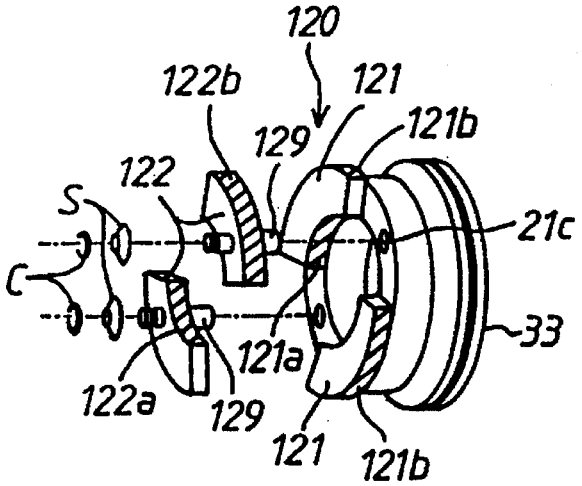
FIG. 22 is a perspective view showing a modification of the intermediate gear set shown in FIGS. 4–6.

Illustrated in FIGS. 19–21 is a further modification of the valve timing adjusting mechanism shown in FIGS. 1–3, wherein the plug 23 and steel ball 24 are replaced with a stepped pin 29 having a small diameter portion axially slidable in a mounting hole 22*e* formed in the auxiliary gear 22 and a large diameter portion pressed into the mounting hole 21*c* of primary gear 21, a dish spring S interposed between the auxiliary gear 22 and an outer end of stepped pin 29 to bias the stepped pin 29 in an axial direction thereby to resiliently engage the stepped pin 29 with the auxiliary gear 22, and a retainer clip C fixed to the outer end of stepped pin 29 to retain the dish spring S in position. The other construction and component parts are the same as those in the valve timing adjusting mechanism shown in FIGS. 1–3. In this modification, each stepped pin 29 assembled with the auxiliary gear 22 by means of the dish spring S and retainer clip C is fixed to the primary gear 21 in a position where backlashes at the meshed portions of the component gears are eliminated. With such arrangement of the stepped pin 29, even if the parallelism of the component gears was out of order due to irregularity of the gears in precision or fluctuation of a tension force acting the timing pulley 18, smooth axial movement of the intermediate gear set 20 would be effected by movement of the auxiliary gear 22 against the dish spring S. In FIG. 22 there is illustrated a further modification of the intermediate gear set 120 shown in FIGS. 4–6, wherein the plug 123 and steel ball 124 are replaced with a stepped pin 129, a dish spring S and a retainer clip C assembled with the primary and auxiliary gears 121 and 122 in the same manner as in the above modification. With such arrangement of the stepped pin 129, even if the parallelism of the component gears was out of order due to irregularity of the gears in precision or fluctuation of a tension force acting on the timing pulley 18, smooth axial movement of the intermediate gear set 120 would be effected by movement of the auxiliary gears 122 against the dish springs S.

Although in the embodiment and modifications described above, the external teeth 14*a* of internal gear 14 and the internal teeth 17*a* of the external gear 17 each are in the form of helical teeth, only either ones of the external teeth 14*a* or the internal teeth 17*a* may be formed as helical teeth. In a practical embodiment of the present invention, the valve timing adjusting mechanism may be provided on a crankshaft of an internal combustion engine.

What is claimed is:

1. A valve timing adjusting mechanism for an internal combustion engine comprising an internal gear formed with external teeth and mounted on either one of a crankshaft or a cam shaft of the engine for rotation therewith, an external gear formed with internal teeth and assembled in surrounding relationship with the internal gear, the external gear being driving connected to the other one of the crankshaft and camshaft for rotation therewith, and an intermediate gear set disposed in an annular space between the internal and external gears to be moved by fluid under pressure applied thereto in an axial direction for effecting relative rotation of the internal and external gears, wherein the intermediate gear set comprises a primary gear formed with internal teeth in meshing engagement with the external teeth of the internal gear and external teeth in meshing engagement with the internal teeth of the external gear, an auxiliary gear formed with internal teeth in meshing engagement with the external teeth of the internal gear and external teeth in meshing engagement with the internal teeth of the external gear, and restriction means interposed between the primary and auxiliary gears in a condition where the primary and auxiliary gears have been disposed in the annular space between the internal and external gears, the restriction means being adapted to adjust an axial distance between the primary and auxiliary gears and being non-movably retained in a position where backlashes at the meshed portions of the component gears are eliminated.

2. A valve timing adjusting mechanism as claimed in claim 1, wherein said restriction means comprises a plug coupled within said primary gear and retained in a position where backlashes at the meshed portions of said component gears are eliminated, said plug being maintained in engagement with said auxiliary gear.

3. A valve timing adjusting mechanism as claimed in claim 1, wherein said restriction means comprises a retainer pin coupled within said primary gear and retained in a position where backlashes at the meshed portions of said component gears are eliminated, said retainer pin being maintained in engagement with said auxiliary gear.

4. A valve timing adjusting mechanism as claimed in claim 1, wherein said restriction means comprises a retainer ring coupled within said primary gear and retained in a position where backlashes at the meshed portions of said component gears are eliminated, said retainer ring being maintained in engagement with said auxiliary gear.

* * * * *